US009044629B2

(12) United States Patent
Ross

(10) Patent No.: US 9,044,629 B2
(45) Date of Patent: Jun. 2, 2015

(54) SLIDING GRIP FITNESS APPARATUS

(71) Applicant: Adam L. Ross, West Chester, OH (US)

(72) Inventor: Adam L. Ross, West Chester, OH (US)

(73) Assignee: Exemplar Design, LLC, Mason, OH (US)

( * ) Notice: Subject to any disclaimer, the term of this patent is extended or adjusted under 35 U.S.C. 154(b) by 188 days.

(21) Appl. No.: 13/756,850

(22) Filed: Feb. 1, 2013

(65) Prior Publication Data

US 2013/0196824 A1 Aug. 1, 2013

Related U.S. Application Data

(60) Provisional application No. 61/593,368, filed on Feb. 1, 2012.

(51) Int. Cl.
*A63B 1/00* (2006.01)
*A63B 21/16* (2006.01)
*A63B 23/12* (2006.01)

(52) U.S. Cl.
CPC ..... *A63B 1/005* (2013.01); *A63B 21/1645* (2013.01); *A63B 23/1218* (2013.01)

(58) Field of Classification Search
USPC ..... 482/38–42, 141, 148
See application file for complete search history.

(56) References Cited

U.S. PATENT DOCUMENTS

| | | | | |
|---|---|---|---|---|
| 3,637,205 | A * | 1/1972 | Bankston | 482/114 |
| 3,971,255 | A * | 7/1976 | Varney et al. | 482/114 |
| 5,152,731 | A * | 10/1992 | Troutman | 482/106 |
| 5,290,209 | A * | 3/1994 | Wilkinson | 482/38 |
| 5,328,427 | A * | 7/1994 | Sleamaker | 482/71 |
| 5,417,628 | A * | 5/1995 | Vanderbleek | 482/40 |
| 6,508,743 | B1 * | 1/2003 | Fortin | 482/41 |
| 6,932,750 | B1 * | 8/2005 | Dorner | 482/142 |
| 7,086,999 | B2 * | 8/2006 | Jeneve et al. | 482/106 |
| 7,223,219 | B2 * | 5/2007 | Liester | 482/126 |
| 7,892,158 | B2 | 2/2011 | Varga | |
| D633,961 | S * | 3/2011 | Loew et al. | D21/679 |
| 8,535,204 | B2 * | 9/2013 | Stacey | 482/40 |
| 8,574,136 | B1 * | 11/2013 | Burstrom | 482/109 |
| 2005/0250619 | A1 * | 11/2005 | Daikeler et al. | 482/40 |
| 2008/0070764 | A1 * | 3/2008 | Amzallag et al. | 482/129 |

OTHER PUBLICATIONS

Altus Athletic Rip Slide Push-Up Bar advertised by Fitness Equipment Express—http://www.fitnessequipmentexpress.com/fitness-accessories/pull-up-bars/altusathleticripslidepushupbar.cfm [Date retrieved—Sep. 17, 2013].

* cited by examiner

*Primary Examiner* — Stephen Crow
(74) *Attorney, Agent, or Firm* — Baker & Hostetler LLP

(57) ABSTRACT

A multi-purpose, adjustable fitness apparatus is provided for performing exercises; in particular, sliding pull-ups and push-ups. Two in-line metal bars are interposed by a T-connector. A sliding handle grip may be disposed on each bar between a pair of retaining collars. A radius elbow including a foot is attached to each bar. A first adapter for a first setting includes a crossbar and elbow tube is slidably locked to the perpendicular leg of the T-connector. The apparatus may be mounted over a doorframe; the elbow tube and T-connector provides adjustability to fit frames of various widths. A second adapter for a second setting includes a third foot fitted to the T-connector, and provides stability on a horizontal surface.

18 Claims, 9 Drawing Sheets

SLIDING GRIP FITNESS APPARATUS

CROSS-REFERENCE TO RELATED APPLICATIONS

This application claims priority to U.S. Provisional Patent Application Ser. No. 61/593,368 filed Feb. 1, 2012, entitled "Exercise Adapter System," the contents of which are incorporated herein by reference in their entirety.

BACKGROUND

The present disclosure relates generally to exercise equipment, and particularly to multiple-function fitness equipment for home or individual use. Some example multiple function exercise equipment includes bodyweight support bars for performing exercises such as pull-ups and push-ups. Some other examples of exercise equipment may include those which maintain a user's proper skeletomuscular alignment, or provide instability in limited directions to both engage the core of a user, such as exercise bars with variable or sliding grip separation.

The apparatus in this disclosure solves the problem of providing a sliding push-up bar and pull-up bar in the same device. Prior art products act as push-up stands or pull-up bars alone, or provide only a static frame without sliding handles. Existing push-up stands may consist of two handles elevated from the ground, or as a single bar placed on the floor or against a wall. Prior art combined pull-up/push-up bars do not provide a sliding function. Currently, U.S. Pat. No. 7,892,158 is provided only as a push-up stand with sliding handles, and includes three feet that sit on the ground and hold up the bar system containing the sliding handles. The apparatus in current disclosure provides horizontally sliding and rotating handles, in a push-up bar and pull-up bar combination.

SUMMARY

A fitness apparatus has an elongated main body, comprised of two bar sections connected rigidly in-line by opposite arms of a T-connector. Each bar section includes a sliding handle between a pair of retaining collars near each end of each tube section. The diameter constricts or tapers at each end of each bar section, the end generally the section from the retaining collar to the end of the bar. A radius elbow having a foot locks to the end of each bar section.

A first adapter for a first pull-up setting includes a crossbar affixed to an elbow tube slidably locked to the perpendicular leg of the T-connector. The apparatus may be mounted above a door frame to provide a horizontal bar for exercises such as sliding grip pull ups. The slidable lock between the T-connector and elbow tube allows the fitness apparatus to accommodate walls of various widths.

A second adapter for a second push-up setting includes a third foot fitted to a perpendicular leg of the T-connector. The apparatus may be set on a horizontal surface for sliding grip push-ups.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

In the drawings:

FIG. 8(*a*) shows the mounting side; FIG. 8(*b*) shows the front side; FIG. 9(*a*) shows an exemplary floor adapter foot; and FIG. 9(*b*) shows perspective view of an exemplary fitness apparatus in a second setting.

DETAILED DESCRIPTION

Figure 1:
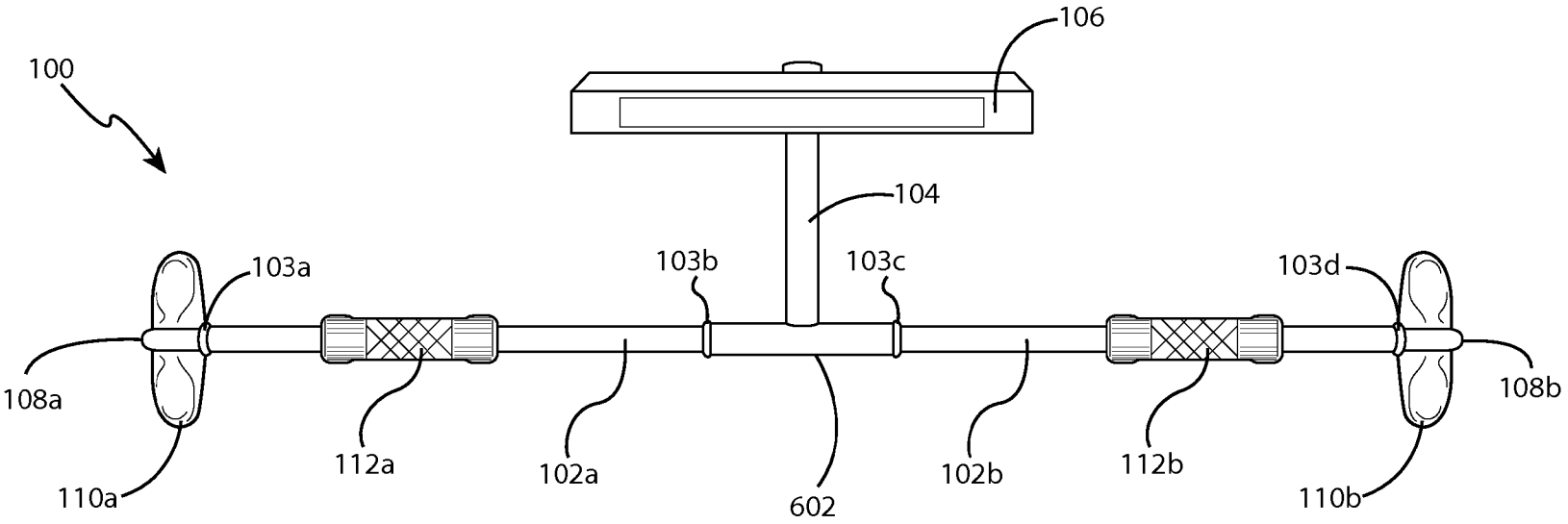
FIG. 1 is a front plan view of an exemplary fitness apparatus in accordance with the disclosure.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be used, and other changes may be made, without departing from the spirit or scope of the subject matter presented here. It will be readily understood that the aspects of the present disclosure, as generally described herein, and illustrated in the Figures, may be arranged, substituted, combined, and designed in a wide variety of different configurations, all of which are explicitly contemplated and make part of this disclosure.

Methods, systems, devices, and/or apparatus related to fitness equipment are described. Some example embodiments according to the present disclosure may pertain to adjustable exercise bars with multiple settings, for developing upper-body and core strength.

Figure 2:
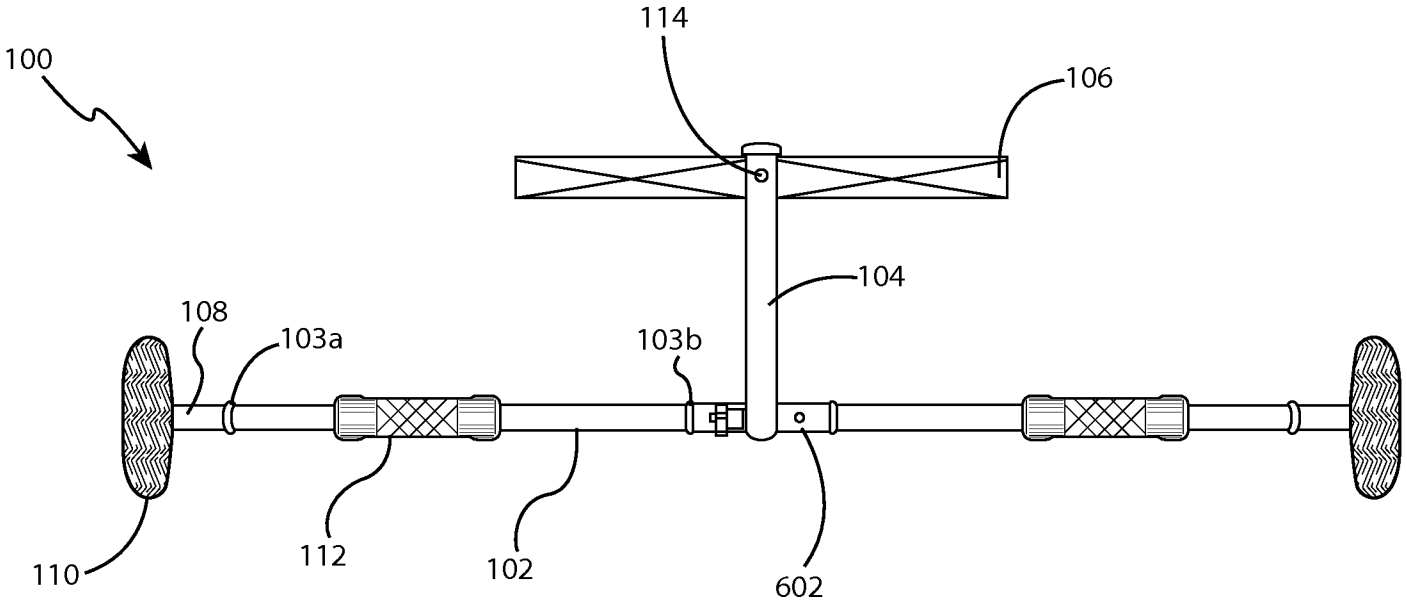
FIG. 2 is a back plan view of the exemplary fitness apparatus of FIG. 1.
Figure 3:
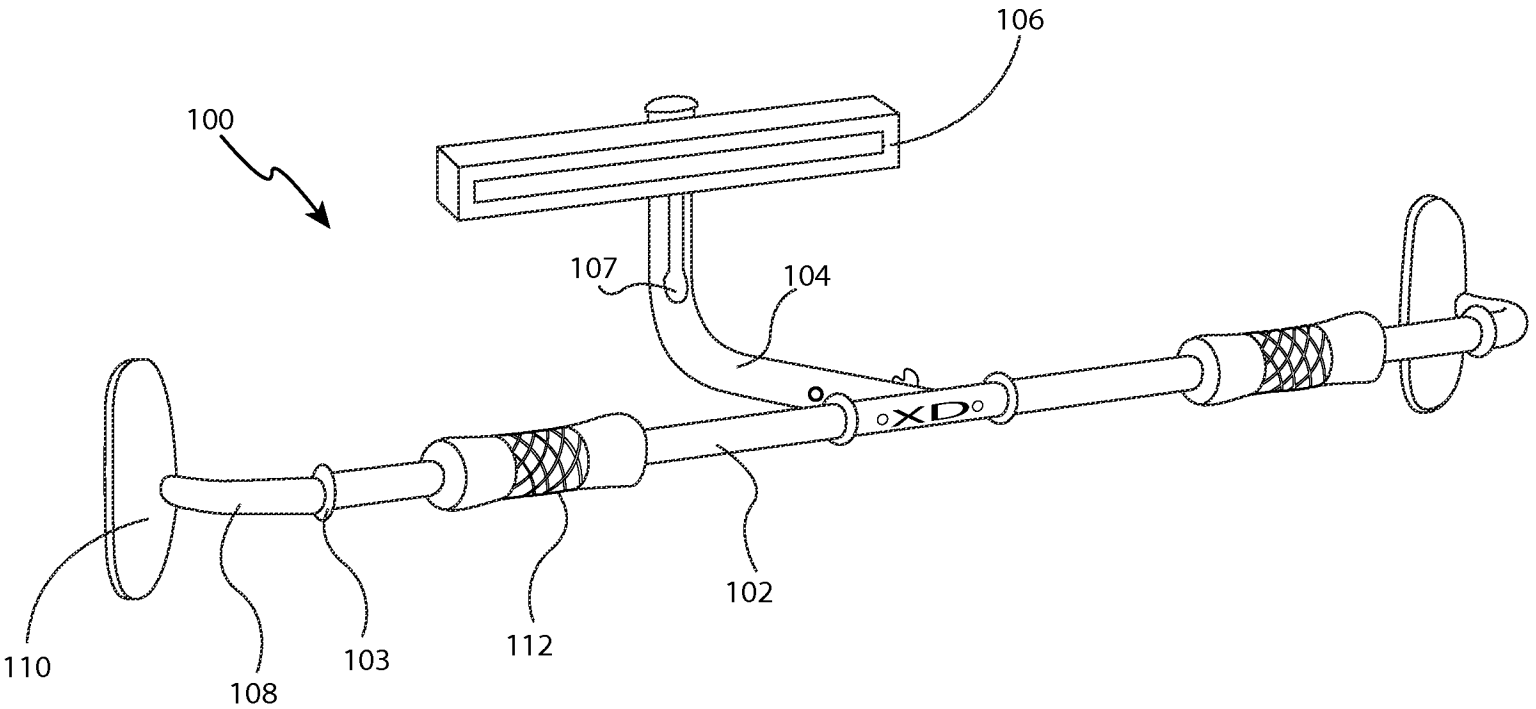
FIG. 3 is a perspective view of the exemplary fitness apparatus of FIG. 1.

Referring to FIGS. 1-3, perspective views of an exemplary embodiment of the fitness apparatus 100 are shown. FIG. 1 is a front plan view of apparatus 100, as a user may approach apparatus 100 for use. FIG. 2 is a back plan view of apparatus 100 from the mounted side of a wall. FIG. 3 is a perspective view of apparatus 100, to discern lateral aspects of apparatus 100.

Apparatus 100 may be comprised of two generally identical elongated bars, 102*a* and 102*b*, which may be referred to as a single reference numeral 102 for simplicity. Each bar 102*a* and 102*b* includes two retaining collars 103*a* and 103*b*; and 103*c* and 103*d* respectively, located near the end of each bar 102. A T-connector 602 is rigidly disposed between bars 102*a* and 102*b* at the proximal end of each bar 102, and connecting bars 102*a* and 102*b* in a generally straight line.

A radius elbow 108 may be attached to each bar 102 at the distal end of bar 102 beyond retaining collar 103. Radius elbow 108 bends at approximately a 90 degree angle, and each radius elbow 108 includes a foot 110. Each foot 110 may be flat on the bottom side, and canted on the top side from the center to the edges, to form a stable base and distribute a pressure exerted on bar 102. Foot 110 is offset from bar 102 by a vertical leg of the radius elbow 108, and any longer side of foot 110 may be substantially perpendicular to the bar 102.

A handle 112 may be disposed on each bar 102. Each handle 112 slides freely along bar 102, between retaining collars 103, which prevent handles 112 from sliding off bars 102. Retaining collars 103 may be formed of metal or rubber. Handle 112 may be metal, and covered with a grip such as rubber, silicone, plastic, cork, foam, wood. Handle 112 may slide along bar 102 with a sliding mechanism, such as, but not limited to, ball bearings.

FIG. 3 shows elbow tube 104, slidably attached to T-connector 602. Relative to T-connector 602, elbow tube 104 may have lateral extension 104*a* and vertical extension 104*b*. A crossbar 106 may be attached to an elbow tube 104*b* by bolt 114 (FIG. 2), and may be generally parallel to bar 102. Slot 107 may allow elevation adjustments of apparatus 100.

Figure 4:
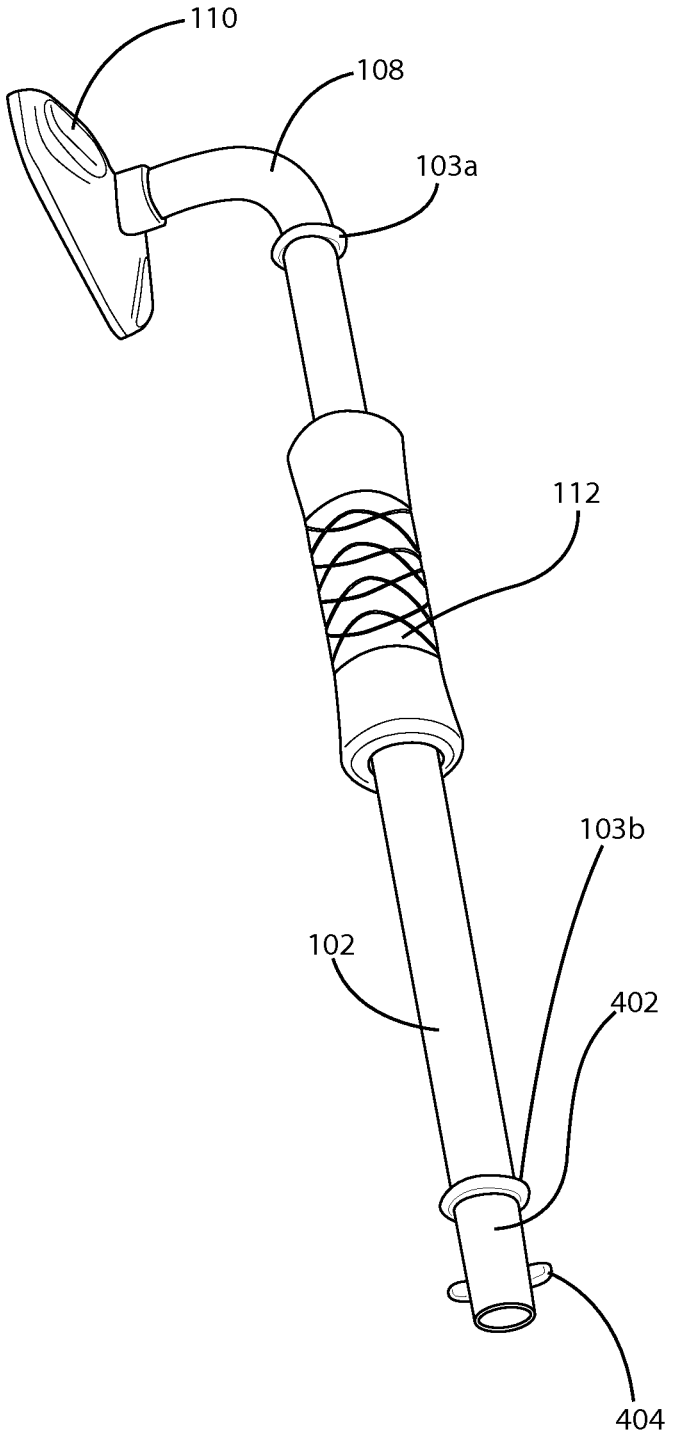
FIG. 4 is a perspective view of an exemplary tube section of the fitness apparatus of FIG. 1.

FIG. 4 is a view of an individual bar 102. Bar 102 is disengaged from T-connector 602 to reveal the ends 402 of bar 102. Ends 402 may be of a smaller diameter than body of bar 102 to allow uniform diameter across apparatus 100 when bars 102 are fitted into a connection tube. For example, the inner diameter of the connection tube may approximate the outer diameter of bar end 402. Ends 402 may include rounded, spring-loaded pins 404. Spring-loaded pins 404 may depress upon the application of pressure, and spring back upon the removal of pressure. For example, pins 404 may be pushed into the interior of bar 102 by T-connector 602 barrel 702 (shown in FIG. 7), and spring-lock into T-connector 602 hole 608. In alternate embodiments, other connecting and locking mechanisms may be in place, such as a threaded, or a twist lock connection.

Figure 5:
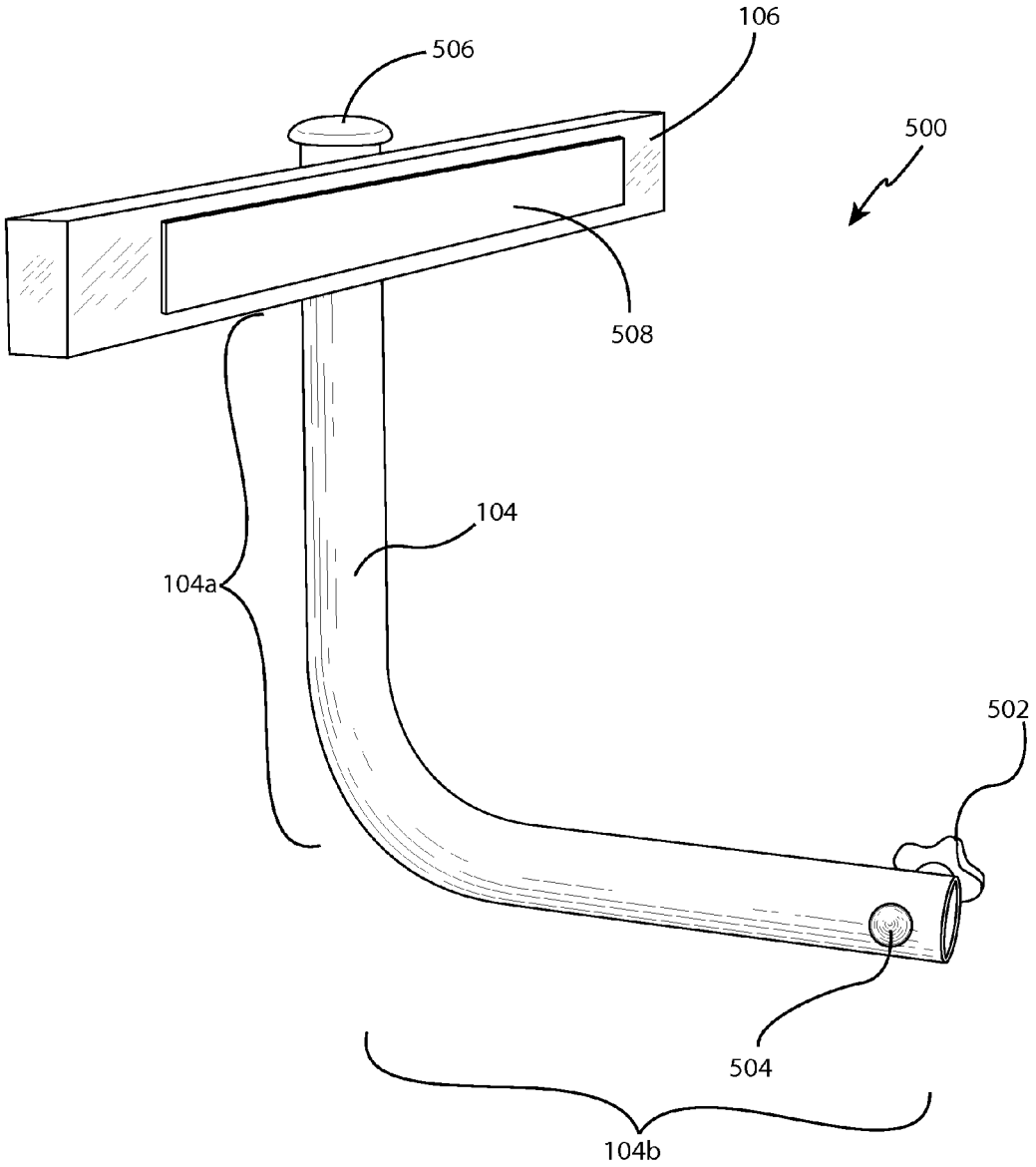
FIG. 5 is a perspective view of an exemplary door frame adapter.

FIG. 5 shows an elevated view of a first adapter 500, to mount apparatus 100 in a pull-up setting. Elbow tube 104 may include a proximal end 104*a* and a distal end 104*b* which meet at approximately a 90 degree angle. Elbow tube 104 may include end cap 406. Elbow tube 104*b* may connect to a crossbar 106. Crossbar 106 may be a hollow or solid rectangular prism, and may include a thin, compressible strip 508 such as felt, on its wall facing side when apparatus 100 is mounted (FIG. 8). In an exemplary embodiment, crossbar 106 may be plastic for weight savings, and reduce wall damage. Bolt 504 and corresponding threaded locking knob 502 extend through a diameter of elbow tube 104*a*. Locking knob 502 allows a user to loosen or tighten knob 502 against bolt 504 without tools.

Figure 6:
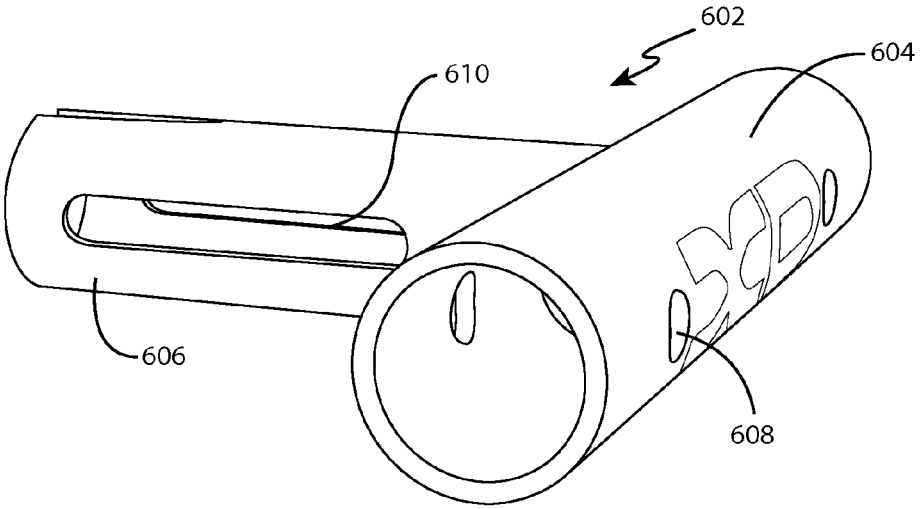
FIG. 6 is a perspective view of an exemplary T-connector.

FIG. 6 is a perspective view of T-connector 602 with arm 604 and perpendicular leg 606, and pin receiving holes 608 in both arm 604 and leg 606. Perpendicular leg 606 includes an elongated track or slot 610 through its diameter. Slot 610 extends a partial length of leg 606, may be rounded at the ends, and may be a width sized to fit a threaded portion of bolt 504.

Figure 7:
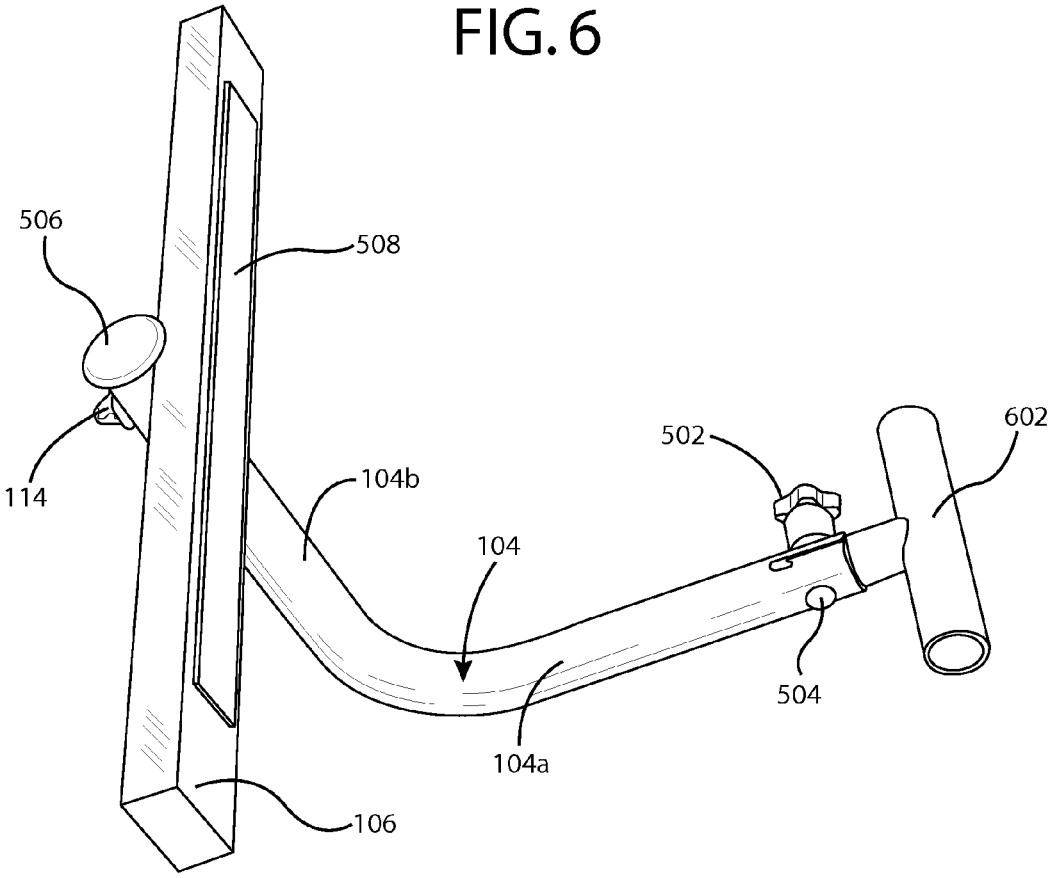
FIG. 7 is a perspective view of an exemplary elbow tube, cross bar and T-connector.

FIG. 7 shows adapter 500 attached to T-connector 602. Elbow tube 104 may be slidably attached to T-tube 602, and may lock into a position along slot 610. Elbow tube 104 may be fitted over T-connector 602, secured together by bolt 504 and knob 502 inserted through elbow tube 104 and slot 606. Elbow tube 104*a* may telescope along T-connector 602 by sliding bolt 504 along slot 610. At a desired lateral extension, knob 502 may be tightened to bolt 504 to secure the length. Crossbar 106 may be attached to the interior side of elbow tube 104*b* with bolt 114, which extends through elbow tube 104*b* into the interior of crossbar 106.

Knob 502 may be loosened to allow elbow tube 104*a* to slide along T-connector 602. Knob 502 may be completely unscrewed and removed from bolt 504, to allow separation of elbow tube 104 from T-connector 602, such as for changing between a pull-up and a push-up setting of apparatus 100.

Figure 8A:
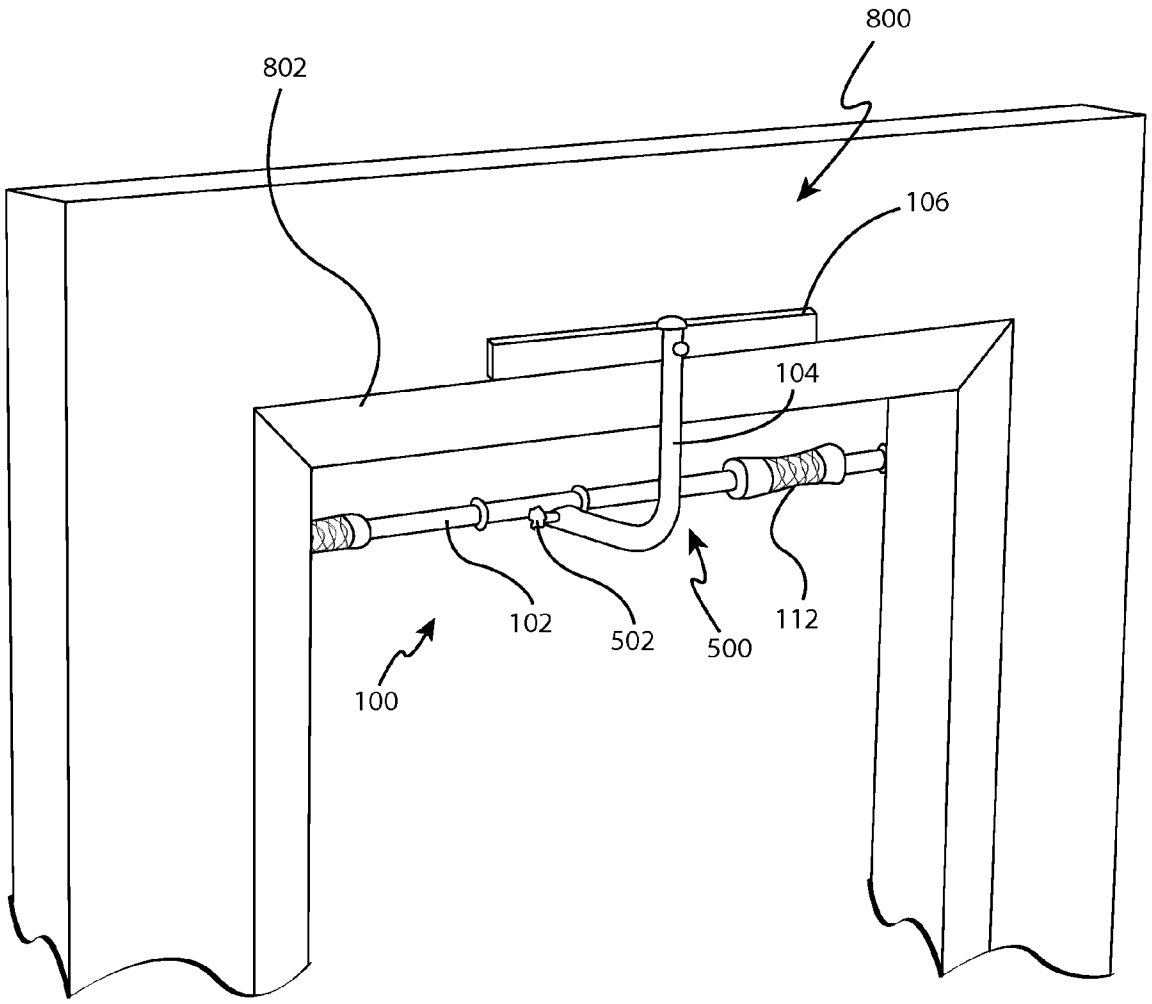
FIG. 8 is an exemplary fitness apparatus in a first setting.
Figure 8B:
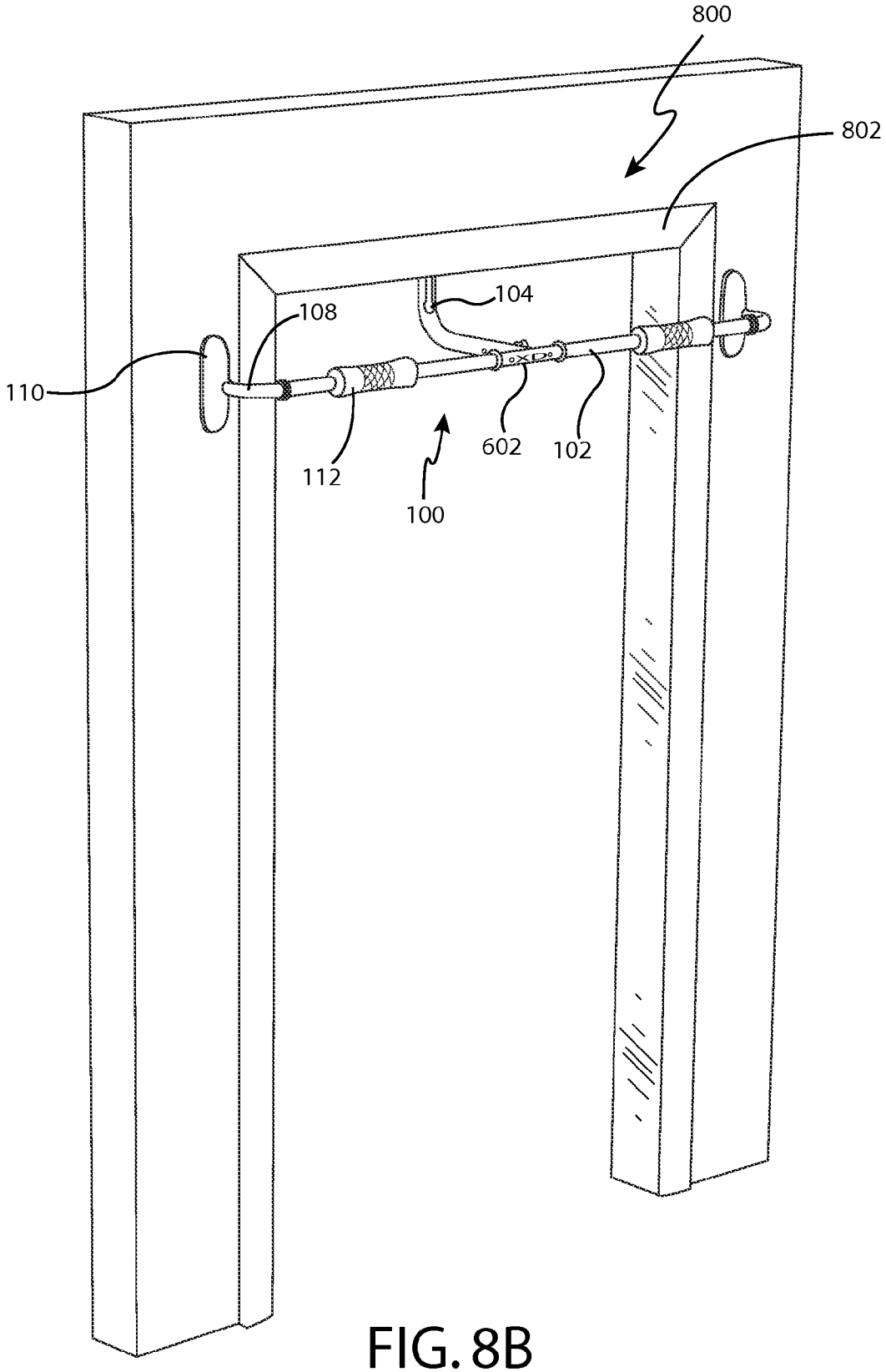

In a first setting of an exemplary embodiment, FIG. 8A and FIG. 8B show apparatus 100 mounted over a door frame 802 on a wall 800. Apparatus 100 may be mounted by placing the crossbar 106 over a ledge of the door frame 802 on a first side of a wall 800, resting the feet against the second side of the wall 800. Elbow tube 104 may be telescoped along T-connector 602 to an appropriate length, and tightening the bolt 504 and threaded knob 502.

FIG. 8A shows crossbar 106 on a ledge of a doorframe against a first side of wall 800, while bar 102 and handles 112 are on a second side of wall 800. Crossbar 106 opposes a downward force, and a rotational force of apparatus 100. Apparatus 100 may be adjusted for various wall 800 thickness by sliding elbow tube 104 along T-connector 602 in the steps described above.

FIG. 8B shows apparatus 100 mounted to a wall 800 as it would be approached for pull-ups. Feet 110 transfer a rotational force of bar 102 into wall 800. Because crossbar 106 and feet 112 transfer opposing forces into wall 800, apparatus 100 remains stable over the door frame 802. Handles 112 freely slide along bar 102 as a user performs pull-ups.

Figure 9A:
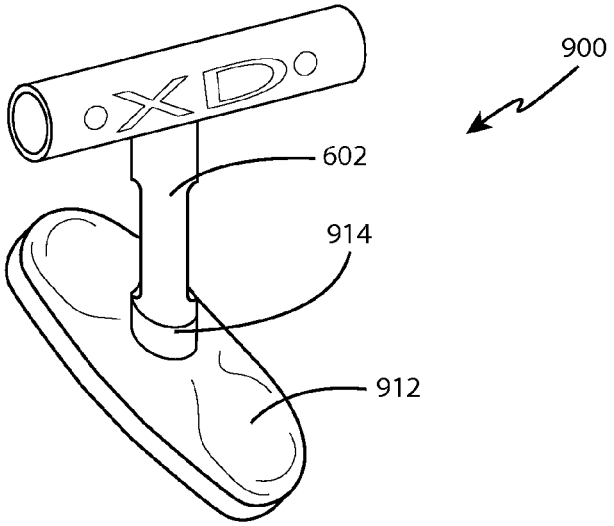
FIG. 9 is an exemplary fitness apparatus in a second setting.
Figure 9B:
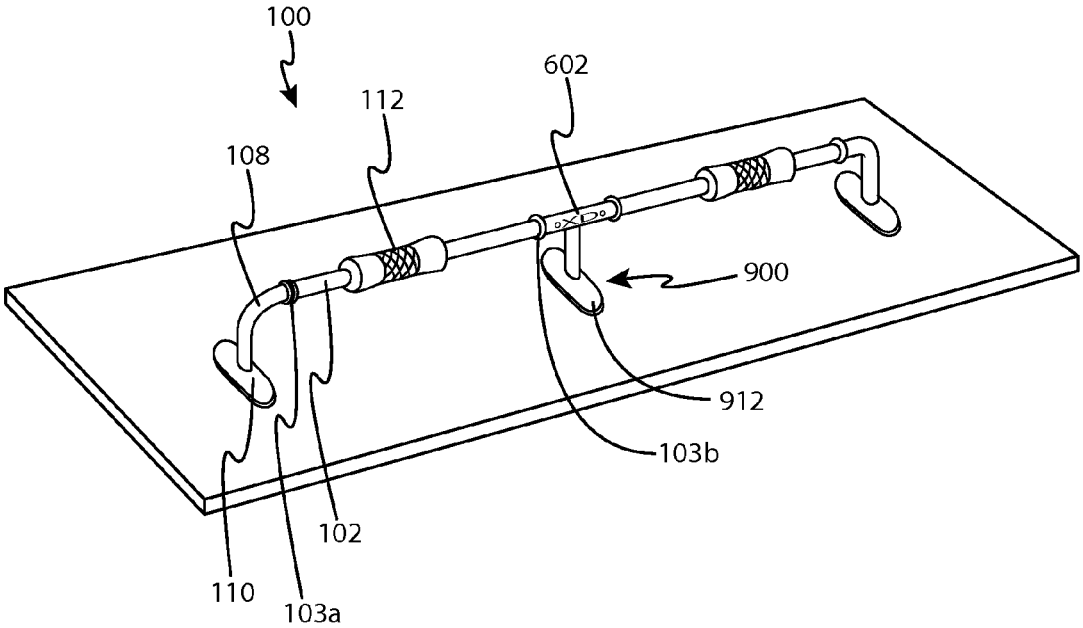

FIG. 9 is a second, push-up, setting of an exemplary embodiment of apparatus 100. FIG. 9A shows adapter 900, including foot 912 as it may be connected to T-connector 602 with tube 914. As shown in FIG. 9B, adapter 900 and feet 112 elevate bar 102 above a horizontal surface. Handle 112 may freely slide along bar 102. For increased stability, any longer length of each foot 112 and 912 may be rotated to lie perpendicular to bar 102.

What is claimed is:

1. A fitness apparatus comprising:

two linearly aligned elongated bars;

a T-connector rigidly interposed in-line between the two linearly aligned elongated bars;

a handle slidably attached on each elongated bar; and a first detachable adapter to mount the apparatus for pull-ups, the first adapter comprising a crossbar affixed to the distal end of an elbow tube, wherein the proximal end of the elbow tube is selectively locked along the length of the T-connector.

2. The fitness apparatus of claim 1, wherein:

the T-connector has opposite arms and a perpendicular leg.

3. The fitness apparatus of claim 1, wherein:

the elbow tube and T-connector are telescoped.

4. The fitness apparatus of claim 1, further comprising:

a lateral through-slot along a portion of the T-connector; and a bolt inserted through the elbow tube and the T-connector lateral through-slot, and coupled with a threaded knob.

5. The fitness apparatus of claim 4, wherein:

the knob is one of: fluted, and made from plastic.

6. The fitness apparatus of claim 1, further comprising:

a retaining collar on each end of each elongated bar, each respective handle disposed between the retaining collars of each respective bar.

7. The fitness apparatus of claim 1, further comprising:

a radius elbow attached to the distal end of each elongated bar, each radius elbow having an attached foot.

8. The fitness apparatus of claim 1, wherein:

the diameter of each respective bar gradually decreases at the ends of each respective bar.

9. The fitness apparatus of claim 1, wherein:

the elongated bars, T-connector, and elbow tube are made from metal.

10. The fitness apparatus of claim 1 wherein
the feet are provided with one of rubber pads and felt pads.

11. The fitness apparatus of claim 1, further comprising:
the handles include a padded grip.

12. The fitness apparatus of claim 1, further comprising:
a pin approximate each end of each elongated bar; and
a hole on the T-connector to receive the pin.

13. The fitness apparatus of claim 12, wherein:
the pin is rounded, and spring-loaded.

14. The fitness apparatus of claim 1, wherein:
the elongated bars are threadedly connected to the T-connector.

15. The fitness apparatus of claim 1 further comprising:
a second detachable adapter to mount the apparatus for push-ups, the second detachable adapter comprising a third foot attached to the T-connector.

16. A fitness apparatus comprising:
two linearly aligned elongated bars;
a retaining collar near each end of each elongated bar;
a T-connector rigidly interposed in-line between the two linearly aligned elongated bars;
a radius elbow attached to the distal end of each elongated bar, each radius elbow having an attached foot;
a slidable handle on each elongated bar, the handle disposed between the retaining collars of each bar; and
a first and a second alternate adapter, wherein the first adapter mounts the apparatus to a door frame, and the second adapter elevates the apparatus off a horizontal surface wherein the first adapter comprises a crossbar affixed to an elbow tube, and wherein the elbow tube is slidably attached to the T-connector.

17. The fitness apparatus of claim 16, further comprising:
a bolt and threaded knob selectively locks the elbow tube at a point along a longitudinal through-slot of the T-connector.

18. The fitness apparatus of claim 16 wherein the second detachable adapter comprises a third foot attachable to the T-connector.

* * * * *